US006268596B1

(12) United States Patent
Lauf et al.

(10) Patent No.: US 6,268,596 B1
(45) Date of Patent: Jul. 31, 2001

(54) APPARATUS AND METHOD FOR MICROWAVE PROCESSING OF LIQUIDS

(75) Inventors: Robert J. Lauf, Oak Ridge, TN (US); Zakaryae Fathi, Cary; Denise A. Tucker, Raleigh, both of NC (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/379,850

(22) Filed: Aug. 24, 1999

(51) Int. Cl.[7] ..... H05B 6/74; H05B 6/78

(52) U.S. Cl. ..... 219/687; 219/745; 219/726; 219/751; 422/21

(58) Field of Search ..... 219/687, 688, 219/689, 745, 746, 748, 749, 750, 751, 756, 762, 679, 686, 726; 422/21

(56) References Cited

U.S. PATENT DOCUMENTS

| | | | |
|---|---|---|---|
| 3,611,135 | 10/1971 | Margerum . | |
| 4,144,468 | 3/1979 | Mourier . | |
| 4,196,332 | 4/1980 | MacKay et al. . | |
| 4,340,796 | 7/1982 | Yamaguchi et al. . | |
| 4,415,789 | 11/1983 | Nobue et al. . | |
| 4,504,718 | 3/1985 | Okatsuka et al. . | |
| 4,593,167 | 6/1986 | Nilssen . | |
| 4,777,336 | 10/1988 | Asmussen . | |
| 4,825,028 | 4/1989 | Smith . | |
| 4,843,202 | 6/1989 | Smith et al. . | |
| 4,866,344 | 9/1989 | Ross et al. . | |
| 4,889,966 * | 12/1989 | Meredith | 219/745 |
| 4,937,418 * | 6/1990 | Boulard | 219/751 |

(List continued on next page.)

FOREIGN PATENT DOCUMENTS 1-274380 * 11/1989 (JP) ..... 219/745

OTHER PUBLICATIONS

A. K. Bose et al "Microwave–Induced Rapid Reactions for Preparative Organic Chemistry," Proc. 29th Microwave Power Symp., pp. 35–38 Int'l Microwave Power Inst., Jul. 25–27, 1994, Chicago IL.

H. D. Kimrey et al, "Microwave Sintering of Zirconia–Toughened Alumina Composites," Mat. Res. Soc. Symp. Proc., vol. 189, pp. 243–55, 1991.

Terry N . Tiegs et al. "Comparison of Properties of Sintered and Sintered Reaction–Bonded Silicon Nitride Fabricated by Microwave & Conventional Heating," Mat. Res. Soc. Symp. Proc., vol. 347, pp. 501–6, 1994.

R. A. Abramovitch, "Applications of Microwave Energy in Organic Chemistry. A Review," Org. Prep. Proceed. Int. , 23, pp. 683–711, 1991.

R. J. Lauf et al, "2 to 18 GHz Broadband Microwave Heating Systems," Microwave Journal, Nov. 1993.

B. MacKay et al, "Frequency Agile Sources for Microwave Ovens," Journal of Microwave Power, 14 (1), 1979.

C. E. Holcombe et al "Importance of 'Casketing' for Microwave Sintering of Materials," Journal of Materials Science Letters 9 425–428, 1990.

C. E. Holcombe et al "Microwave Sintering of Titanium Diboride," Journal of Materials Science 26, 3730–3738, 1991.

*Primary Examiner*—Philip H. Leung
(74) *Attorney, Agent, or Firm*—Kirk A. Wilson

(57) ABSTRACT

A microwave heating apparatus designed to allow concentration of microwave power to a liquid sample to be processed, by use of a field-perturbing tool disposed within or proximate to the volume of liquid. Uniformity of processing is achieved by circulating the liquid past the tool during processing. The apparatus and method is particularly useful when used to excite a nonlinear process whereby greater overall process efficiency may be achieved.

42 Claims, 6 Drawing Sheets

U.S. PATENT DOCUMENTS

| | | | | |
|---|---|---|---|---|
| 4,939,331 | | 7/1990 | Berggren et al. . | |
| 5,206,479 | * | 4/1993 | Zakaria et al. | 219/726 |
| 5,308,944 | | 5/1994 | Stone-Elander et al. . | |
| 5,318,754 | | 6/1994 | Collins et al. . | |
| 5,321,222 | | 6/1994 | Bible et al. . | |
| 5,449,887 | | 9/1995 | Holcombe et al. . | |
| 5,520,886 | | 5/1996 | Bennett . | |
| 5,536,292 | | 7/1996 | Holcombe et al. . | |
| 5,728,310 | * | 3/1998 | Ice et al. | 219/686 |
| 6,121,594 | * | 9/2000 | Joines et al. | 219/688 |

* cited by examiner

APPARATUS AND METHOD FOR MICROWAVE PROCESSING OF LIQUIDS

This application is related to U.S. Application No. 09/382,414, entitled "Apparatus And Method For Microwave Processing Of Materials", filed on the same day, and herein incorporated by reference.

This invention was made with Government support under Contract No. DE-AC05-96OR22464 awarded by the U.S. Department of Energy to Lockheed Martin Energy Research, Inc., and the Government has certain rights in this invention.

This invention relates to the field of microwave radiation. More specifically, this invention relates to a microwave furnace having the capability of selectively enhancing the microwave power applied to a liquid sample by the use of tooling within the liquid vessel in the microwave cavity.

In the field of microwave radiation, it is well known that microwave furnaces may be constructed with either a fixed or a variable operating frequency. It has long been known that the interactions of various materials with microwaves are frequency dependent. It has further been observed that sweeping the microwave frequency can be an effective means of creating a relatively uniform power distribution within a multimode applicator cavity ("2 to 18 GHz Broadband Microwave Heating Systems" by R. J. Lauf et al., Microwave Journal, November 1993.) Where uniformity is the main goal, it is therefore desirable to have a microwave furnace that can be operated over a broad frequency range.

Most microwave sources have a very narrow bandwidth because they employ a resonant cavity. Microwave ovens constructed for home use are provided with a magnetron which operates at 2.45 GHz, which is a frequency that has been allocated by the FCC for domestic heating applications. Due to the coupling ability of a 2.45 GHz microwave to water, these ovens are used for cooking foods, drying, and other purposes wherein the principal material to be acted upon is water. However, it is well known that some microwave absorption will normally occur over a range of frequencies when heating a bulk liquid such as organic species and solvents for applications such as microwave assisted chemical synthesis.

The use of frequency sweeping over a wide range as a means of mode stirring has important implications for the use of microwave power to sterilize medical equipment or contaminated wastes. In such uses it is crucial to eliminate "dead" areas in the cavity wherein sufficient power may not be received in order for complete sterilization. Electronic frequency sweeping may be performed at a high rate of speed, thereby creating a much more uniform time-averaged power density throughout the furnace cavity. The desired frequency sweeping may be accomplished through the use of a variety of microwave electron devices. A helix traveling wave tube (TWT), for example, allows the sweeping to cover a broad bandwidth (e.g., 2 to 8 GHz) compared to devices such as the voltage tunable magnetron (2.45±0.05 GHz). Other devices such as klystrons and gyrotrons have other characteristic bandwidths that may be appropriate for selected applications.

Further, fixed-frequency microwave ovens typically found in the home are known to have cold spots and hot spots. Such phenomena are attributed to the ratio of the wavelength to the size of the microwave cavity. With a relatively low frequency microwave introduced into a small cavity, standing waves occur and thus the microwave power does not uniformly fill all of the space within the cavity, and the unaffected regions are not heated. In the extreme case, the oven cavity becomes practically a "single-mode" cavity.

Attempts have been made at mode stirring, or randomly deflecting the microwave "beam", in order to break up the standing modes and thereby fill the cavity with the microwave radiation. One such attempt is the addition of rotating fan blades at the beam entrance of the cavity.

Another method used to overcome the adverse effects of standing waves is to intentionally create a standing wave within a single-mode cavity such that the workpiece may be placed at the location determined to have the highest power (the hot spot). Thus, only that portion of the cavity in which the standing wave is most concentrated with be used.

Other devices have been produced to change the parameters of the heating process of selected materials. Typical of the art is those devices disclosed in the following U.S. Pat. Nos.

| U.S. Pat. No. | Inventor(s) | Issue Date |
|---|---|---|
| 3,611,135 | D. L. Margerum | October 5, 1971 |
| 4,144,468 | G. Mourier | March 13, 1979 |
| 4,196,332 | A. MacKay B, et al. | April 1, 1980 |
| 4,340,796 | M. Yamaguchi, et al. | July 20, 1982 |
| 4,415,789 | T. Nobue, et al. | November 15, 1983 |
| 4,504,718 | H. Okatsuka, et al. | March 12, 1985 |
| 4,593,167 | O. K. Nilssen | June 3, 1986 |
| 4,777,336 | J. Asmussen | October 11, 1988 |
| 4,825,028 | P. H. Smith | April 25, 1988 |
| 4,843,202 | P. H. Smith, et al. | June 27, 1989 |
| 4,866,344 | R. I. Ross, et al. | September 13, 1989 |
| 4,939,331 | B. Berggren, et al. | July 3, 1990 |
| 5,321,222 | D. W Bible et al. | June 14, 1994 |
| 5,318,754 | M. J. Collins et al. | June 7, 1994 |
| 5,520,886 | J. P. Bennett et al. | May 28, 1996 |

The subject matter disclosed by MacKay ('332) is further discussed in an article authored by MacKay B, et al., entitled "Frequency Agile Sources for Microwave Ovens", *Journal of Microwave Power*, 14 (1), 1979. A microwave furnace having a wide frequency range has been disclosed in U.S. Pat. No. 5,321,222, herein incorporated by reference.

The field-perturbing tool of the present invention should not be confused with various contrivances used generally to modify the thermal environment of the workpiece rather than to perturb the local electric field in a known and controllable way. A typical example thereof is the introduction of relatively lossy materials such as silicon carbide whose role is to absorb microwave power and convert that power to radiant heat thereby providing supplemental or "hybrid" heating to the workpiece [see, for example, U.S. Pat. No. 5,318,754 entitled "Microwave Ashing Apparatuses and Components" by M. J. Collins et al. assigned to CEM Corporation]. That type of contrivance is referred to by various terms, such as the "picket fence" of Janney et al. [see H. D. Kimrey et al. "Microwave Sintering of Zirconia-Toughened Alumina Composites", Mat. Res. Soc. Symp. Proc. Vol. 189, pp. 243–55, 1991] and the "casketing" of Holcombe et al. ["Importance of "Casketing" for Microwave Sintering of Materials", Journal of Materials Science Letters 9 (1990), 425–428]. Other contrivances include thermal insulation around the workpiece as well as thermally conductive inserts such as boron nitride to spread the heat within these insulated "caskets" [see, for example, T. N. Tiegs et al. "Comparison of the Properties of Sintered and Sintered Reaction-Bonded Silicon Nitride Fabricated by Microwave and Conventional Heating", Mat. Res. Soc. Symp. Proc. pp. 501–6, 1994]. Yet other contrivances of that nature include packaging for microwave heatable food products such as popcorn and the like. A field-perturbing tool may, of course, provide some supplemental heating because of its own dielectric loss, but such heating, if any, is an incidental benefit of the field-perturbing tool and not its primary purpose.

A wide variety of materials and designs have been developed over the years for containing materials, particularly liquids, during microwave heating operations. One familiar example is microwave cookware for use in the home. Microwave-transparent vessels for heating liquids, as for example, in analytical chemistry procedures, have been developed that in many cases will resist damage from microwave heating and withstand a certain amount of internal pressure created as the contained liquid is heated [see, for example, U.S. Pat. No. 5,520,886 "Explosion Resistant Reinforced Container Assemblies for Materials to be Microwave Heated" by J. P. Bennett et al. assigned to CEM Corporation]. Many of the aforementioned vessels will be suitable for carrying out the present invention.

It is therefore an object of this invention to provide a microwave heating apparatus in which a volume of liquid may be subjected to a controlled application of microwave power.

It is another object of the present invention to provide a microwave heating apparatus in which a volume of liquid may be subjected to a controlled concentration of microwave power while maintaining overall uniformity by moving the liquid.

It is another object of the present invention to provide a microwave heating apparatus in which a liquid may be uniformly exposed to locally concentrated electric fields via a field-perturbing tool whereby one or more nonlinear processes may enhance overall process efficiency.

It is another object of the present invention to provide a method by which a volume of liquid may be subjected to a controlled application of microwave power It is another object of the present invention to provide a method by which a volume of liquid may be subjected to a controlled concentration of microwave power while maintaining uniformity by moving the liquid.

Yet another object of the present invention is to provide a method of microwave heating in which frequency modulation may be used as a form of mode stirring to create a uniform power density and a tool is used to selectively perturb this power density to apply a desired concentration of microwave power to a volume of circulating liquid.

Other objects and advantages will be accomplished by the present invention which is designed to allow concentration of microwave power within a localized volume of liquid through the use of field-perturbing tooling disposed within the liquid for heating or other selected processes. Some applicable processes include chemical synthesis, sterilization, cracking, and polymerization.

A microwave source is provided for generating a high-power microwave signal for input to the microwave cavity and to which the liquid is subjected. The microwave source of the preferred embodiment is able to sweep a given range of frequencies, operate in pulse mode, modulate the frequency of the microwave signal, and produce various complex waveforms, as well as operate at a fixed frequency if desired.

In the preferred embodiments, the microwave source may employ any one of a magnetron, a helix traveling-wave tube (TWT), a coupled-cavity TWT, a ring-loop TWT, a ring-bar TWT, a klystron, a twystron, or a gyrotron. These devices are all familiar to those skilled in the art of microwave system design.

A directional coupler is typically provided for detecting the direction of a signal and further directing the signal depending on the detected direction. A signal received from the microwave source is directed toward the microwave cavity. A signal received from the direction of the microwave cavity is directed toward a reflected power load. The directional coupler thus provides a means whereby reflected power is diverted away from the microwave source in order to protect the microwave source from power unabsorbed by the liquid being treated. The directional coupler of the preferred embodiment is water-cooled for the dissipation of heat collected through the transmission of power from the microwave source and the reflection of power from the microwave cavity.

A power and temperature display controller is provided for measuring the power delivered to the microwave cavity. The power controller is used in conjunction with a power monitor positioned to measure reflected power from the microwave cavity in order to monitor the efficiency of the microwave cavity and to insure that reflected power is dissipated in the reflected power load and not by the microwave source.

The reflected power load may also be used to test the functionality of the system by removing all workpieces from the microwave cavity, thus directing the entire signal from the microwave source into the reflected power load. Comparisons can be made of the power received by the reflected power load and the power delivered from the microwave source to determine any system losses.

The magnitude of the reflected power is detected by the power monitor. This magnitude may be used to determine the efficiency of the instant frequency of the microwave introduced into the microwave cavity. A lower reflected power will indicate a more efficient operating frequency due to the higher absorption rate of the selected workpiece.

A liquid vessel is disposed within the microwave cavity in order to contain the fluid during processing. This vessel may be open to the atmosphere within the microwave cavity or it may be sealed. It may further be capable of some degree of pressurization above or below atmospheric. A field-perturbing tool is disposed within or proximate to the liquid materials in order to perturb the electric field from a first distribution that would normally exist in the cavity with only the liquid present at a given power and frequency to a second distribution that will generally be characterized by a localized high concentration of electric field. If more than one such field-perturbing tool is disposed throughout the volume of the vessel, the operation of the field-perturbing tools may be enhanced by sweeping the microwave frequency in a substantially continuous manner over some useful bandwidth, typically 5%. In any case, uniformity is further enhanced by circulating the liquid past the field-perturbing tool. The liquid vessel may be a simple vessel for holding a batch of liquid or it may be a tube with an inlet to and outlet from the applicator cavity to allow liquid to be pumped continuously through the cavity.

The above mentioned features of the invention will become more clearly understood from the following detailed description of the invention read together with the drawings in which.

For a better understanding of the present invention, together with other and further objects, advantages and capabilities thereof, reference is made to the following disclosure and appended claims in connection with the above-described drawings.

A microwave heating apparatus incorporating various features of the present invention is illustrated generally in the FIGS. 1–6. The microwave heating apparatus is designed to allow modulation of the frequency and/or power of the microwaves introduced into a microwave cavity for heating or other selected processes. Frequency modulation is an effective method of mode stirring as a means to create a generally uniform power distribution in a relatively small microwave cavity.

Figure 1:
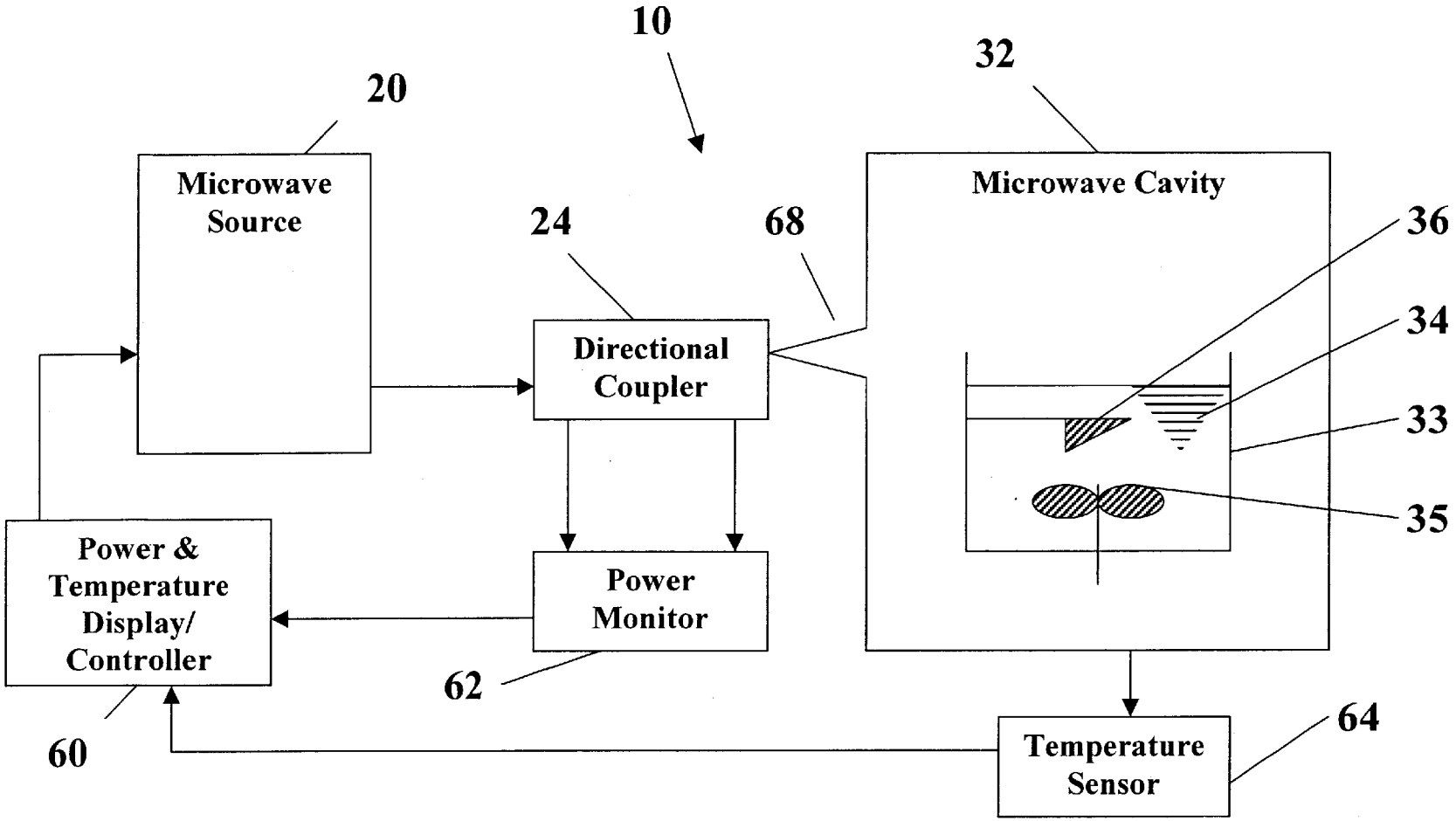
FIG. 1 is a schematic diagram of a preferred embodiment of the microwave heating apparatus of the present invention suitable for processing a liquid in a batchwise manner.

FIG. 1 illustrates schematically the preferred embodiment of the microwave heating apparatus 10 of the present invention, wherein a selected liquid material 34 is to be processed. Applicable processes include, but are not limited to, chemical synthesis, sterilization, cracking, and polymerization. It will be understood that the term "liquid" as used within the present disclosure refers to any substantially fluid material or composition of materials. The term "liquid" may further include such selected material or composition of materials as dispersed solid particulates in a liquid suspension, or an emulsion of two or more immiscible liquids and may, therefore, exist in more than one phase at a given time.

Illustrated in FIG. 1 is one embodiment of the microwave heating apparatus 10. In this embodiment, a power and temperature display and controller 60 receives input from a power monitor 62 and a temperature sensor 64. The power monitor 62 receives input from the directional coupler 24 and serves to measure the reflected and forward power levels as previously described. The power and temperature display and controller 60 further serves to control the microwave source 20.

A tapered waveguide coupler 68 may be provided to enhance the efficiency with which the broadband microwave power is coupled into the microwave cavity. By acting as an impedance transformer between the transmission line from the directional coupler 24 and the microwave cavity 32, this transition increases the percentage power coupled into the microwave cavity 32. In addition, for applications in which the microwave power must be coupled into a microwave cavity 32 in which liquids or vapors are present, the tapered waveguide 68 provides a means of reducing the power density of the microwave power at the interface between the microwave input window and reactive gases or condensates, thus preventing the formation of plasma discharges at the microwave input window. A vessel 33 is disposed within the cavity 32 in order to contain the liquid material 34. The vessel 33 is preferably constructed of a microwave transparent material such as glass, quartz, polymers, or the like. A stirring means 35 is preferably disposed within the vessel 33, although it will be understood that in some circumstances adequate mixing might be achieved by agitation of the vessel 33 or by natural convection as the liquid material 34 is heated by the microwave power. Also disposed within or proximate to the vessel 33 is a field-perturbing tool 36 whose primary purpose is to perturb the electric field within the liquid material 34 in order to create one or more localized areas of greater intensity as shown schematically in FIG. 3.

The vessel 33 may be open, as shown, or it may be sealed. A sealed vessel 33 might be used for processes to be conducted at pressures greater or less than ambient, under a controlled atmosphere, or to maintain a solvent reflux condition, for example.

Figure 2:
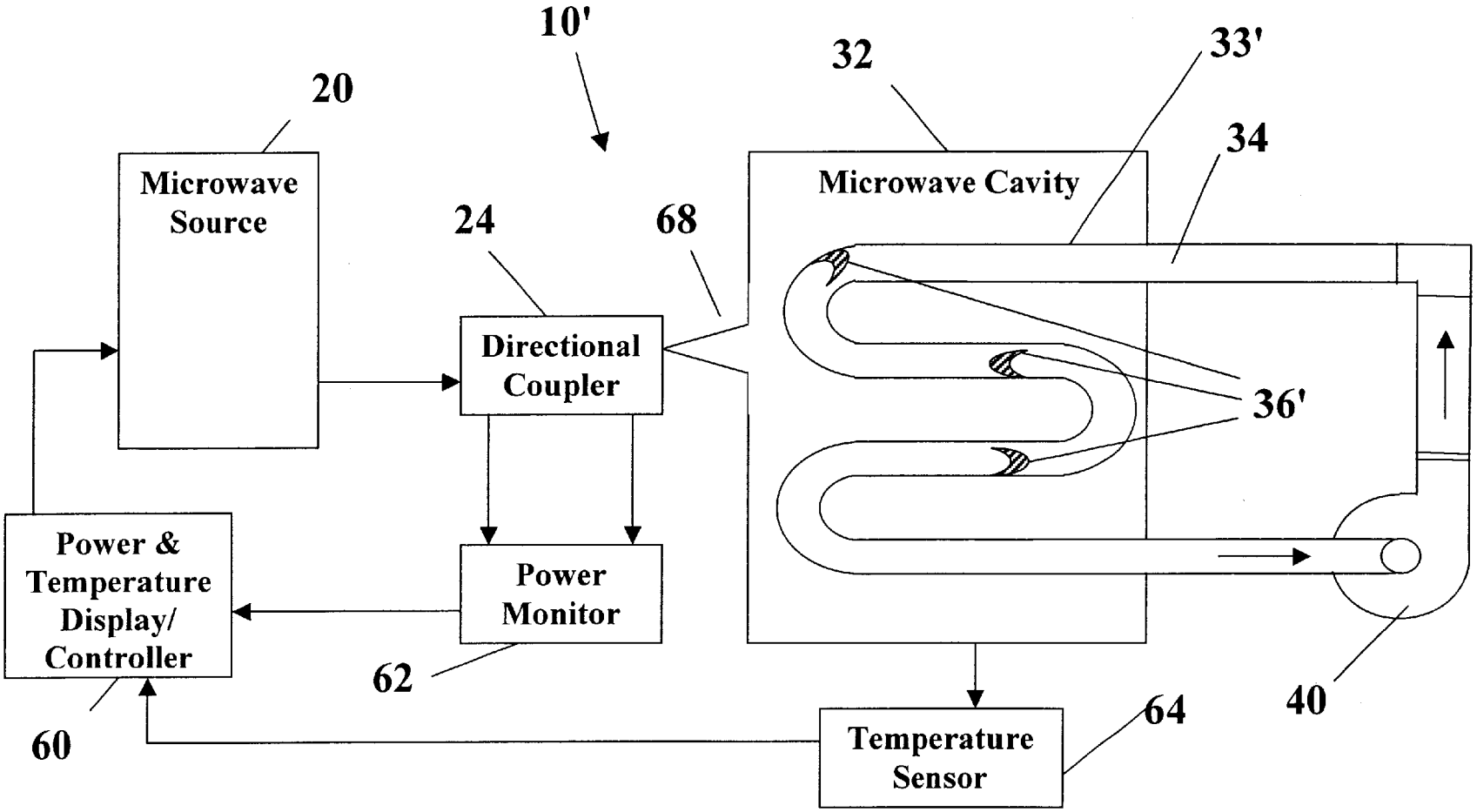
FIG. 2 is a schematic diagram of another preferred embodiment of the microwave heating apparatus of the present invention suitable for processing a liquid in a continuous or recirculating manner.

Illustrated in FIG. 2 is an alternate embodiment of the microwave heating apparatus 10' of the present invention. In this alternate embodiment, the "batch" type fluid vessel 33 is replaced by an elongated tube 33' through which liquid 34 may be circulated in a continuous or semicontinuous manner by an external pump 40. One or more field-perturbing tools 36' are disposed within the elongated tube 33' in order to create localized areas of greater electric field across which the liquid material 34 passes as it is pumped through the elongated tube 33'. It will be understood that the field-perturbing tools 36' may be configured to perform the additional function of increasing turbulence to improve mixing in the circulating fluid. The tube 33' may be configured to make several traverses of the cavity 32 (as shown in FIG. 2) or it might make a single pass through the cavity 32, particularly if the cavity 32 is a single mode cavity operating at its fundamental resonant frequency.

As discussed in the publication ["2 to 18 GHz Broadband Microwave Heating Systems" by R. J. Lauf et al., Microwave Journal, November 1993] the use of frequency sweeping can enhance the uniformity of microwave power throughout the volume of a multimode cavity. This is particularly useful if a number of field-perturbing tools are disposed throughout the cavity or throughout the liquid volume. From the aforementioned published results, it is clear that a bandwidth of as little as 5% of the center frequency could, in some cases, provide sufficient mode plurality to provide relatively uniform baseline energy distribution to be perturbed by each field-perturbing tool regardless of its position within the microwave cavity.

It will be later shown that the present invention may be carried out equally well in either a fixed- or a variable-frequency microwave heating apparatus, and in a single- or a multi-mode applicator cavity. These variations are within the range of options available to the system designer while retaining the desirable attributes of the present invention.

In another issued U.S. Pat. No. 08/413,608, filed Mar. 30, 1995, entitled "Variable Frequency Microwave Heating Apparatus" , which is herein incorporated by reference, and in several publications, it is described how frequency sweeping over a selected bandwidth, typically 5%, could establish a substantially uniform microwave power distribution within the cavity by the superposition of many hundreds of microwave modes. The present invention is based on a discovery that this relatively uniform power distribution could be intentionally perturbed by foreign objects within the cavity or by sharp discontinuities in the workpiece itself (The occasional arcing from sharp metal objects in a home microwave oven is an extreme example of this phenomenon). Although these perturbations are generally thought to be undesirable, it has been discovered, surprisingly, that the phenomenon can be usefully employed, particularly as a technique to concentrate microwave power in a localized area to drive a nonlinear process.

In a microwave-assisted plasma processing operation, for example, it was discovered that it was possible to selectively ignite a localized plasma adjacent to the workpiece. Such a plasma may be selectively ignited by a metallic tool in a suitable shape (such as a knife edge) disposed close to the workpiece. In order to evenly process a workpiece of a selected size and shape, it was observed that moving the workpiece relative to the tool could enhance uniformity, particularly if frequency sweeping was also used to spread the effective area across the entire working surface of the tool. It was subsequently realized that if this technique can locally excite a plasma, which is nonlinear with respect to electric field, it would be equally possible to drive other nonlinear processes, particularly those that might occur in a liquid undergoing chemical reactions in response to microwave excitation. It was further realized that the processing of liquid materials presents a unique opportunity because one can circulate the fluid past one or more tools so that every part of the liquid has an opportunity to spend an equal amount of time in the near-vicinity of the tool, thereby being subjected to the high-field effect, while the fluid circulation automatically maintains uniformity of results for the entire volume of liquid. This surprising combination of localizing or concentrating microwave power by the tool and maintaining uniformity of processing and control throughout the entire batch by fluid circulation represents the essence of the present invention.

Those skilled in the art will appreciate that the concept can be carried out in a number of different ways:

1. The liquid may be processed batchwise in a vessel held within the microwave applicator cavity. One or more field-concentrating tools may be attached to the walls of the vessel and a stirring means can be used to circulate the fluid past these tools. Additionally, the microwave frequency may be varied in order to create a relatively uniform concentration of power at each tool regardless of its position within the vessel.
2. The liquid may be stirred with a metal blade having such a size and shape that it functions as the field concentrating means as well as the fluid circulating means.
3. The liquid may be processed in a continuous manner by circulating through a tube that passes within the applicator cavity. The field concentrating tools may be affixed to the inner walls of the tube, which is constructed of materials that are at least partially transparent to microwave power. Alternatively, the field-perturbing tool might be disposed within or proximate to the microwave transparent tube in cases where one might not wish for the field-perturbing tool to come into direct contact with the fluid being processed. (This approach might be appropriate for biological or corrosive fluids, or the processing of blood and blood products, for example.) In this embodiment, the cavity may be a single-mode or a multi-mode cavity and the tube can make one or more passes through the cavity.
4. The tool may take the form of one or more thin metal objects that are freely circulating within the liquid volume, and are kept circulating or suspended by natural or forced convection.

It will be appreciated that the field-perturbing tool may be grounded or it may be electively biased at an electrical potential relative to ground. It will be further understood hat any potential above or below ground potential may be a DC or AC potential. The aforementioned ability to selectively bias the field-perturbing tool will further increase its utility and applicability for specific applications.

As will be illustrated in the following examples, the aforedescribed microwave heating system can be configured into a wide range of designs to selectively treat a variety of liquids and carry out a variety of processing operations by introducing special field-perturbing tools within the microwave cavity to create a desired spatial power distribution by selectively perturbing the "baseline" power density created in the cavity by the microwave source itself

EXAMPLE I

Figure 3:
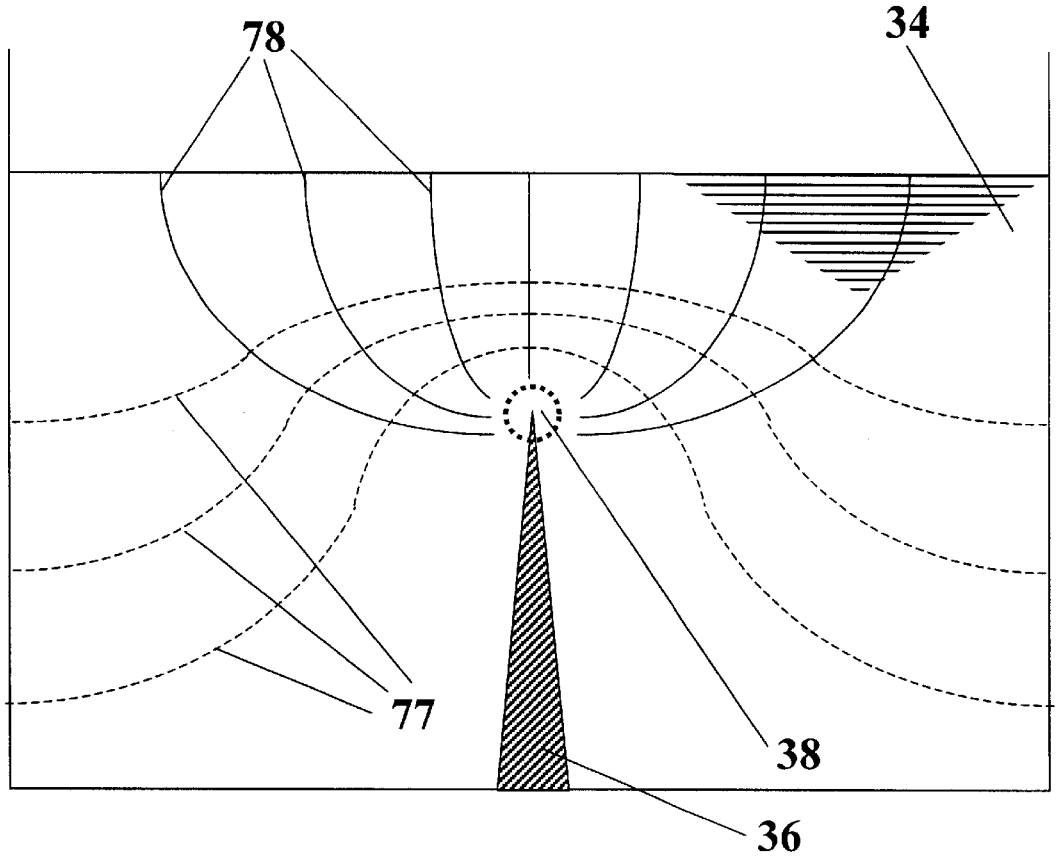
FIG. 3 is a graphical illustration of the electric field density near a sharp discontinuity in a dielectric medium, representing a metallic field-perturbing tool disposed within a liquid in accordance with the present invention.
Figure 4:
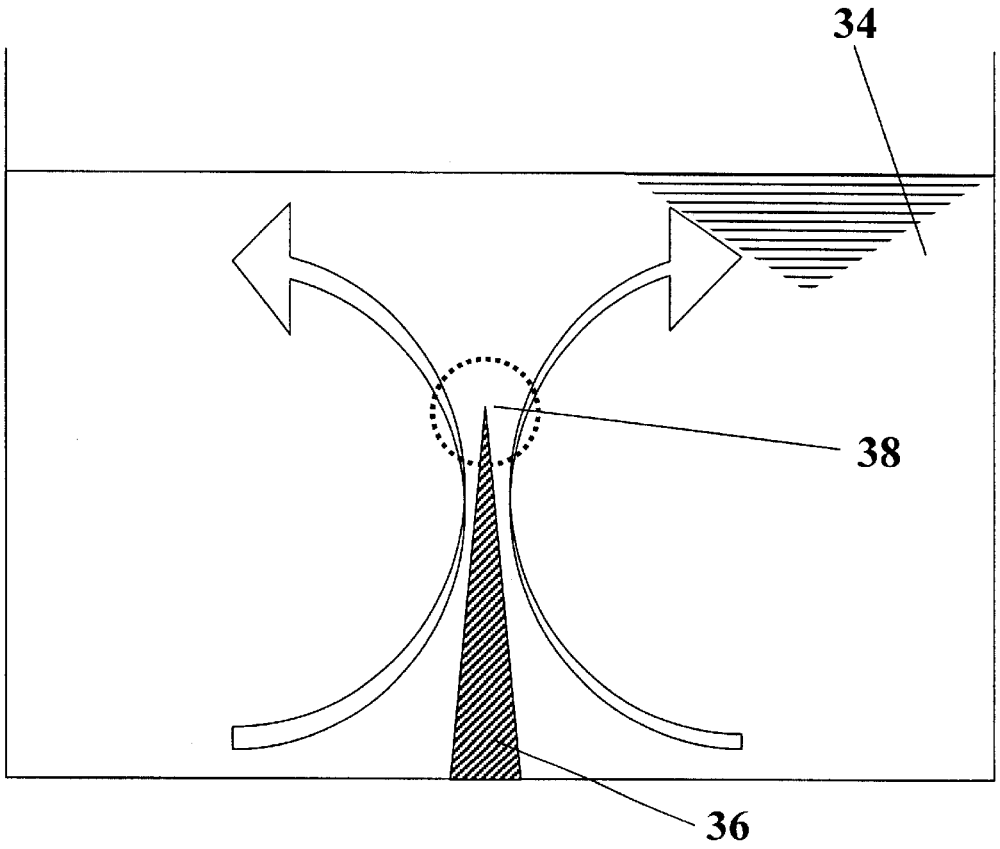
FIG. 4 illustrates the method wherein a liquid to be processed circulates through a region of enhanced electric field by natural or forced convection.

The general effect of the field-perturbing tool 36 is shown in FIG. 3, which illustrates schematically the field distribution around a sharp conductive object within a dielectric liquid 34. It will be understood that the conductivity of the field-perturbing tool 36 must be greater than that of the liquid 34, but the field-perturbing tool 36 may be a metallic conductor or a semiconductor while satisfying this condition. Isopotential lines 77 (dashed) and field lines 78 (solid) show the concentration of power in the area indicated generally at 38. FIG. 4 shows one aspect of the method in which the liquid 34 circulates by free or forced convection (as indicated by the bold arrows) in such a way that all of the liquid 34 passes through the high field area 38 one or more times during processing.

The significance of the foregoing illustration will be clear to those skilled in the art, viz., that if a highly nonlinear process is being driven by the microwave power, then the overall process efficiency or yield could be proportionately increased by the method. The field-perturbing tools obviously do not increase the total microwave power in the cavity, which is clearly set by the input power from the microwave generator. However, by concentrating the power in a known and well-controlled way, and by virtue of a nonlinear process operating in the liquid, the net result is a large improvement in processing. In general, one can determine experimentally whether a nonlinear process is operative in a given system by comparing the yield under two conditions: first, with a constant power input (say, 100 W) and then with a pulsed power input having the same average power (say 1000 W on a 10% duty cycle). If the yield is enhanced in the latter case, it is an indication of a process that is nonlinear with respect to electric field or microwave power density, and which would potentially benefit from the method. Any combination of microwave cavity and source will be characterized by some power density distribution. The field-perturbing tool will enhance the aforementioned distribution and thereby improve process results.

EXAMPLE II

Figure 5:
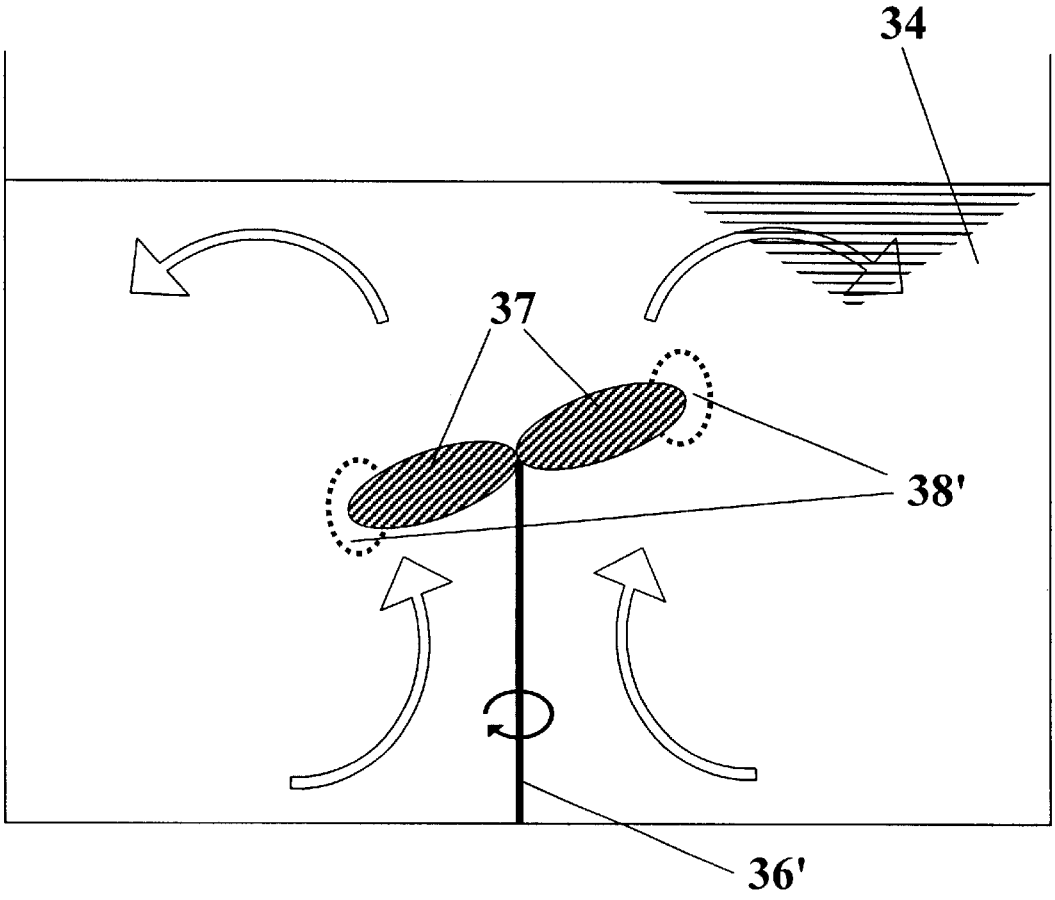
FIG. 5 illustrates a field-perturbing tool that also serves as the fluid circulating means thereby forcing convective flow of the liquid through the regions of enhanced electric field; and, FIG. 6 illustrates the use of field-perturbing tools that are freely circulating within the liquid, rather than affixed to the vessel.

In previous embodiments, it was assumed that the field-perturbing tool 36 is stationary and the liquid 34 is circulated past the field-perturbing tool 36 by a separate pump 40, agitator 35, natural convection, or other means. FIG. 5 shows a metal field-perturbing tool 36' that simultaneously functions as the liquid circulating means. As the field-perturbing tool 36' is rotated, liquid 34 flows past the vanes 37, each of which has an area of enhanced electric field 38' at its edge. The vanes 37 may be configured to further enhance the field perturbation by, for example, placing sharp edges or projections on one or more of their surfaces.

EXAMPLE III

In the recirculating system illustrated in FIG. 2, the field-perturbing tools 36' may be small, thin blades, wires, or other suitable shapes to create a number of small zones of enhanced electric field. The portion of the tube 33' that lies within the microwave cavity 32 must be at least partially constructed of a suitable microwave transparent material such as glass, rubber, plastic or the like. It may be rigid or flexible. If the tube 33' contains multiple field-perturbing tools 36' and makes multiple passes through the cavity 32, thereby having field-perturbing tools 36' disposed at many different locations throughout the cavity 32, then it is preferable to use a microwave source 20 whose useful bandwidth is at least 5% of its center frequency thereby establishing a relatively uniform power density throughout the cavity 32 to make maximal use of all of the field-perturbing tools 36'.

EXAMPLE IV

It will be understood that the field-perturbing tool 36 can take virtually any form that provides one or more localized areas of enhanced electric field 38.

Figure 6:
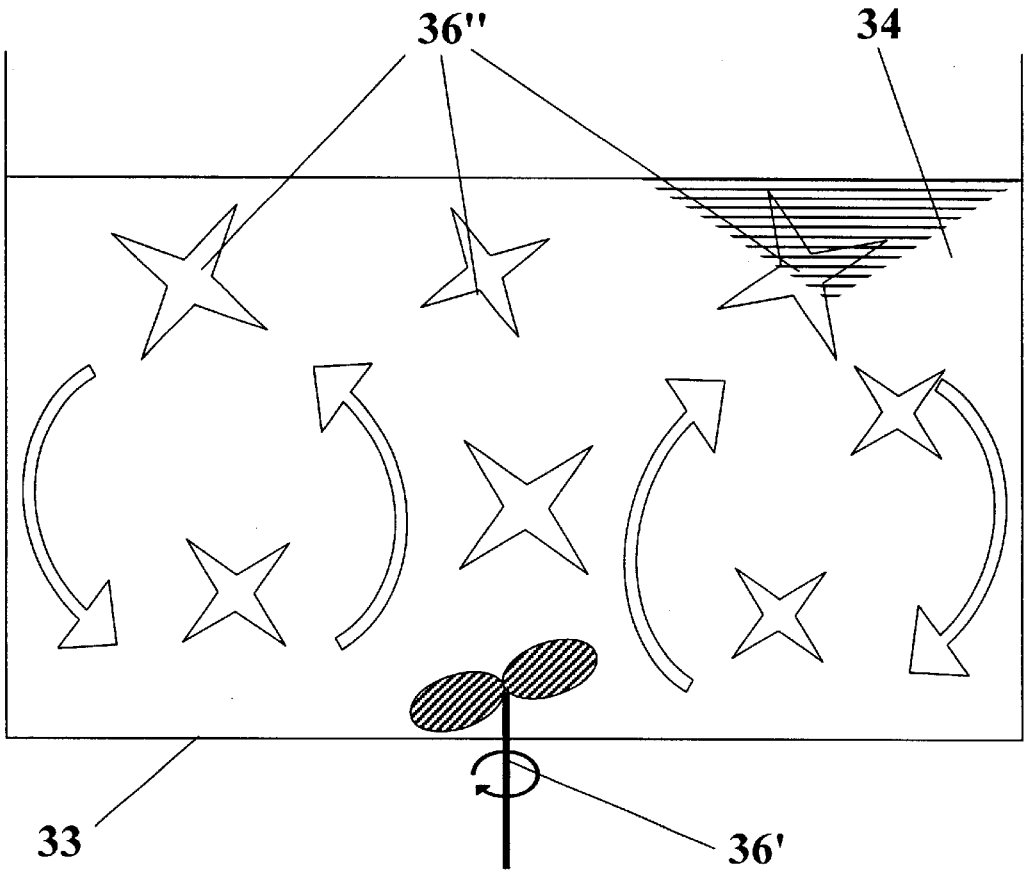

While the foregoing examples illustrated field-perturbing tools 36 that were essentially fixed relative to the vessel 33, it is also possible to achieve some field concentration using field-perturbing tools 36" that comprise sharp metal objects that circulate within the liquid 34 as shown schematically in FIG. 6.

It will be appreciated that the present invention may be employed for a very wide variety of processes, particularly in the field of chemical synthesis. The use of microwave heating to enhance chemical reactions of various sorts has been summarized by R. A. Abramovitch "Applications of Microwave Energy in Organic Chemistry. A Review" Org. Prep. Proceed. Int., 23, pp. 683–711 (1991). Further examples of the art are provided by A. K. Bose et al. "Microwave-Induced Rapid Reactions for Preparative Organic Chemistry" Proc. 29th Microwave Power Symp., pp. 35–38, Int'l Microwave Power Institute, Jul. 25–7, 1994, Chicago, Ill. The reactions discussed in the foregoing publications are typical of the processes that could benefit from the present invention.

While several preferred embodiments have been shown and described, and several examples have been specifically delineated, it will be understood that such descriptions are not intended to limit the disclosure, but rather it is intended to cover all modifications and alternate methods falling within the spirit and the scope of the invention as defined in the appended claims or their equivalents.

What is claimed is:

1. An apparatus for microwave processing a liquid material comprising:

a microwave cavity;

a vessel for containing a liquid material, said vessel at least partially disposed within said cavity;

a microwave source disposed to direct microwaves into said cavity;

at least one field perturbing tool having a selected size, shape, and composition, said tool disposed to apply a controlled, localized concentration of microwave power to at least one selected portion of said liquid material; and a means for controllably circulating said liquid material relative to said tool so that over time said concentration of microwave power is applied in turn to substantially all portions of said liquid material.

2. The apparatus of claim 1 wherein said field perturbing tool is integral with said means for controllably circulating said liquid material relative to said tool so that said concentration of microwave power is applied to substantially all portions of said liquid material.

3. The apparatus of claim 1 wherein said vessel further comprises an elongated tube, said tube being at least partially transparent to microwave power.

4. The apparatus of claim 1 wherein said tool comprises a plurality of electrically conductive objects.

5. The apparatus of claim 1 wherein said tool comprises at least one electrically conductive object and said vessel is at least partially transparent to microwave power.

6. The apparatus of claim 1 wherein said tool comprises at least one generally planar electrically conductive object, wherein a generally sharp edge of said object is contiguous with said liquid material.

7. The apparatus of claim 1 wherein said tool comprises at least one generally elongated electrically conductive object, wherein a generally sharp point of said object is contiguous with said liquid material.

8. The apparatus of claim 1 wherein said tool is biased at a selected electrical potential relative to ground.

9. The apparatus of claim 1 wherein said microwave processing is selected from the group consisting of chemical synthesis, sterilization, cracking, and polymerization.

10. The apparatus of claim 1 wherein said liquid material is selected from the group consisting of an essentially liquid material, an essentially liquid mixture, a mixture of liquid and solid materials, a mixture of dispersed solid materials in a liquid suspension, and a mixture of two or more immiscible liquids.

11. An apparatus for microwave processing a liquid material comprising:

a microwave cavity;

a vessel for containing a liquid material, said vessel at least partially disposed within said cavity, said vessel maintaining an internal pressure greater than or less than atmospheric;

a microwave source disposed to direct microwaves into said cavity;

at least one field perturbing tool having a selected size, shape, and composition, said tool disposed to apply a controlled, localized concentration of microwave power to at least one selected portion of said liquid material; and, a means for controllably circulating said liquid material relative to said tool so that over time said concentration of microwave power is applied in turn to substantially all portions of said liquid material.

12. The apparatus of claim 11 wherein said field perturbing tool is integral with said means for controllably circulating said liquid material relative to said tool so that said concentration of microwave power is applied to substantially all portions of said liquid material.

13. The apparatus of claim 11 wherein said vessel further comprises an elongated tube, said tube being at least partially transparent to microwave power.

14. The apparatus of claim 11 wherein said tool comprises a plurality of electrically conductive objects.

15. The apparatus of claim 11 wherein said tool comprises at least one electrically conductive object and said vessel is at least partially transparent to microwave power.

16. The apparatus of claim 11 wherein said tool comprises at least one generally planar electrically conductive object, wherein a generally sharp edge of said object is contiguous with said liquid material.

17. The apparatus of claim 11 wherein said tool comprises at least one generally elongated electrically conductive object, wherein a generally sharp point of said object is contiguous with said liquid material.

18. The apparatus of claim 11 wherein said tool is biased at a selected electrical potential relative to ground.

19. The apparatus of claim 11 wherein said microwave processing is selected from the group consisting of chemical synthesis, sterilization, cracking, and polymerization.

20. The apparatus of claim 11 wherein said liquid material is selected from the group consisting of an essentially liquid material, an essentially liquid mixture, a mixture of liquid and solid materials, a mixture of dispersed solid materials in a liquid suspension, and a mixture of two or more immiscible liquids.

21. A method for microwave processing a liquid material comprising the steps of:

a. disposing said liquid material in a vessel;

b. disposing said vessel at least partially within a microwave cavity;

c. exposing said liquid material to microwaves from a microwave source disposed to direct microwaves into said cavity;

d. disposing at least one field perturbing tool having a selected size, shape, and composition to apply a controlled, localized concentration of microwave power to at least one selected portion of said liquid material; and, e. circulating said liquid relative to said tool whereby said concentration of microwave power is applied in turn to substantially all portions of said liquid material.

22. The method of claim 21 wherein said field perturbing tool is integral with said liquid material so that said concentration of microwave power is applied to substantially all portions of said liquid material.

23. The method of claim 21 further comprising circulating said liquid material between said vessel and an external reservoir.

24. The method of claim 21 wherein said vessel further comprises an elongated tube, said tube being substantially transparent to microwave power.

25. The method of claim 21 wherein said tool comprises a plurality of electrically conductive objects.

26. The method of claim 21 wherein said tool comprises at least one electrically conductive object and said vessel is at least partially transparent to microwave power.

27. The method of claim 21 wherein said tool comprises at least one generally planar electrically conductive object wherein a generally sharp edge of said tool is contiguous with said liquid material.

28. The method of claim 21 wherein said tool comprises at least one generally elongated electrically conductive object wherein a generally sharp point of said tool is contiguous with said liquid material.

29. The method of claim 21 wherein said tool is biased at a selected electrical potential relative to ground.

30. The method of claim 21 wherein said microwave processing is selected from the group consisting of chemical synthesis, sterilization, cracking, and polymerization.

31. The method of claim 21 wherein said liquid material is selected from the group consisting of a substantially fluid material, a substantially fluid mixture, a mixture of fluid and solid materials, a mixture of dispersed solid materials in a liquid suspension, and a mixture of two or more immiscible fluids.

32. A method for microwave processing a liquid material comprising the steps of:

a. disposing said liquid material in a vessel, said vessel maintaining an internal pressure greater than or less than atmospheric;

b. disposing said vessel at least partially within a microwave cavity;

c. exposing said liquid material to microwaves from a microwave source disposed to direct microwaves into said cavity;

d. disposing at least one field perturbing tool having a selected size, shape, and composition to apply a controlled, localized concentration of microwave power to at least one selected portion of said liquid material; and, e. circulating said liquid relative to said tool whereby said concentration of microwave power is applied in turn to substantially all portions of said liquid material.

33. The method of claim 32 wherein said field perturbing tool is integral with said liquid material so that said concentration of microwave power is applied to substantially all portions of said liquid material.

34. The method of claim 32 further comprising circulating said liquid material between said vessel and an external reservoir.

35. The method of claim 32 wherein said vessel further comprises an elongated tube, said tube being substantially transparent to microwave power.

36. The method of claim 32 wherein said tool comprises a plurality of electrically conductive objects.

37. The method of claim 32 wherein said tool comprises at least one electrically conductive object and said vessel is at least partially transparent to microwave power.

38. The method of claim 32 wherein said tool comprises at least one generally planar electrically conductive object wherein a generally sharp edge of said tool is contiguous with said liquid material.

39. The method of claim 32 wherein said tool comprises at least one generally elongated electrically conductive object wherein a generally sharp point of said tool is contiguous with said liquid material.

40. The method of claim 32 wherein said tool is biased at a selected electrical potential relative to ground.

41. The method of claim 32 wherein said microwave processing is selected from the group consisting of chemical synthesis, sterilization, cracking, and polymerization.

42. The method of claim 32 wherein said liquid material is selected from the group consisting of a substantially fluid material, a substantially fluid mixture, a mixture of fluid and solid materials, a mixture of dispersed solid materials in a liquid suspension, and a mixture of two or more immiscible fluids.

* * * * *